US005938408A

United States Patent [19]

Krichbaum

[11] Patent Number: 5,938,408

[45] Date of Patent: Aug. 17, 1999

[54] MAGNETICALLY CONTROLLED LIQUID TRANSFER SYSTEM

[75] Inventor: Charles W. Krichbaum, Mercer, Pa.

[73] Assignee: E.R. Advanced Ceramics, Inc., East Palestine, Ohio

[21] Appl. No.: 08/913,877

[22] PCT Filed: May 31, 1996

[86] PCT No.: PCT/US96/08172

§ 371 Date: Sep. 12, 1997

§ 102(e) Date: Sep. 12, 1997

[87] PCT Pub. No.: WO96/41956

PCT Pub. Date: Dec. 27, 1996

Related U.S. Application Data

[60] Provisional application No. 60/000,160, Jun. 12, 1995.

[51] Int. Cl.[6] ..... F04F 1/02

[52] U.S. Cl. ..... 417/87; 417/127; 417/128; 417/131; 417/146; 417/149

[58] Field of Search ..... 417/85, 86, 87, 417/127, 128, 131, 138, 144, 145, 146, 147, 149

[56] References Cited

U.S. PATENT DOCUMENTS 2,141,427 12/1938 Bryant .
3,932,065 1/1976 Ginsberg ..... 417/317
4,964,784 10/1990 Vanderheyden .
5,007,803 4/1991 DiVito ..... 417/130
5,141,404 8/1992 Newcomer et al. .

*Primary Examiner*—Timothy S. Thorpe
*Assistant Examiner*—Ehud Gartenberg
*Attorney, Agent, or Firm*—Sand & Sebolt

[57] ABSTRACT

A compressed air-actuated pump includes a venturi nozzle (24) to create a vacuum condition within a fluid-tight pump body or chamber (8) to pump in a liquid or slurry from a remote location. When a given level of liquid is pumped in, a float mechanism (69, 97, 101) actuates a magnetic air valve (60) which actuates a diverter valve (40) whereby the pressurized air from the venturi nozzle is diverted into the pump body to create a pressurized condition therein, whereby the liquid or slurry previously accumulated therein is pumped out. The magnetic actuated valve and diverter valve controlled thereby insures that the desired amount of liquid or slurry is always discharged from the pump chamber during each pressure cycle, and drawn into the chamber during the suction or fill cycle. In a second embodiment, liquid flows into the pump chamber under the influence of gravity and an air-actuated ON/OFF switch (116), which is controlled by the magnetic air valve, regulates the flow of pressurized air into the pump chamber to force the liquid therefrom upon the liquid reaching an upper fill level.

20 Claims, 6 Drawing Sheets

MAGNETICALLY CONTROLLED LIQUID TRANSFER SYSTEM

CROSS-REFERENCED RELATED APPLICATION

This application is a standard application of Provisional Patent Application Ser. No. 60/000,160, filed Jun. 12, 1995.

BACKGROUND OF THE INVENTION

1. Technical Field

The invention relates to a liquid transfer system. More particularly, the invention relates to a magnetically controlled liquid transfer system which uses a ferrous actuator and a magnetic air valve to control the directional flow of compressed air passing either through a venturi manifold to create either a vacuum condition or a pressure condition within a pump chamber or flowing directly into the pump chamber allowing for the transfer of liquids from one location to another.

2. Background Information

Liquid transfer systems allow for the transfer of liquids from one location to another without the possibility of contaminating the liquids with lubricants which may be contained within the pump. These liquid transfer systems have been in use for many years and patents can be traced back as far as 1938, as evidenced by U.S. Pat. No. 2,141,427. The theory behind these systems is that compressed air which is passed through a venturi manifold and out an exhaust creates a jet stream. By passing this jet stream directly over an opening in a pump chamber, a vacuum is induced within the pump chamber. The bottom of the chamber includes an inlet passage and an outlet passage each containing a one-way check valve. When the vacuum condition exists within the pump chamber liquid is drawn through the inlet valve and into the pump chamber. When the liquid reaches a certain level within the chamber a valve is shut at the exhaust forcing the air through the opening in the pump chamber and creating a downward pressure on the liquid which forces the liquid out through the outlet valve to another location. This suction-discharge pumping cycle is repeated until the compressed air is discontinued.

In the alternative, the compressed air may flow directly into the pump chamber for forcing the liquid therefrom, which liquid enters the chamber through the force of gravity, such as in a condensation-type of pump.

U.S. Pat. No. 2,141,427 shows a transfer system incorporating a float mechanism to regulate the level of the liquid within the pump chamber. A spring and piston is used to change the directional flow of the compressed air and thus change the pumping cycle from suction to discharge.

One problem with some of the prior art liquid transfer systems is that while corrosive, erosive, or abrasive liquids are drawn into the pump chamber, the level of liquid rises and approaches the opening in the pump chamber. Liquid may splash or be drawn into the jet stream contacting operational elements of the pump or are blown out of the exhaust and into the surrounding environment.

Other difficulties with some prior art liquid transfer systems are with the mechanisms and methods used to measure the level of the liquid and to control the directional flow of air within the pump chamber. U.S. Pat. No. 3,932,065 shows a prior art transfer system which utilizes a pneumatically controlled air valve to change the directional flow of the liquid. The liquid transfer system of the present invention utilizes a magnetically controlled diverter valve to perform the same task.

U.S. Pat. No. 5,007,803 shows a liquid transfer system which uses either two opto-electronic sensors or a pneumatic timing device to signal the opening and closing of a pinch valve. The pinch valve is placed at the exhaust and includes an internal flexible sleeve. When the pinch valve is in an open position air flows through the sleeve and out the exhaust. When in a closed position, pressure is applied against the flexible sleeve causing the sleeve to pinch inwardly closing off the airflow through the exhaust. When the valve is closed the air is directed into the chamber forcing the liquid through the outlet valve. Although the system of this patent is presumably adequate for the purpose for which it was intended, the present invention avoids the drawbacks of this prior art liquid transfer system.

One drawback of this prior art liquid transfer system is the use of the pinch valve. The pinch valve requires 30 psi to close the flexible sleeve and redirect the compressed air into the pump chamber. Therefore, if the pump is being operated at, for example 50 psi during both the pressure and suction cycles, an additional 30 psi or a total of 80 psi would be required to close the pinch valve. This reservation of the total available pumping pressure decreases the efficiency and speed of the pump.

Another drawback of the system of U.S. Pat. No. 5,007,803 is that it uses timers to control the pump cycles. These timers have defined ranges which restrict the period of the pumping cycles. Liquids with a high viscosity have a slower flow rate than liquids with a lower viscosity. Thus during the suction cycle these high viscosity liquids take a longer period of time to be drawn into the pump chamber and the timer may time-out and switch cycles before the liquid sufficiently fills the pump chamber. During the discharge cycle if a large head pressure exists, the timers may time-out before the liquid is completely discharged from the pump chamber. Thus in both the suction and the discharge cycles the maximum amount of fluid may not be transferred from and to the desired locations, and time that could be spent pumping liquids is spent switching cycles.

Another type of liquid transfer system is referred to as a condensation pump, in which liquid enters a pump chamber under the influence of gravity, after which it is subsequently discharged by various control means, including float valves. However, the control systems of these prior art condensation pumps do not provide the advantages of the magnetically controlled system of the present invention.

Thus, the need exists for a liquid transfer system which allows the maximum amount of liquid to be transferred per pumping cycle, which requires minimal air pressure to switch between cycle positions, which allows a greater amount of the air pressure to be used for pumping, and which provides a device within the pump chamber to restrict liquids from being splashed or sucked up through the pump chamber opening possibly coming into contact with operational pump elements or being blown into the surrounding environment.

SUMMARY OF THE INVENTION

Objectives of the present invention include providing a magnetically controlled liquid transfer system which uses a ferrous actuator, a magnetic air valve, and a float mechanism to control the suction and discharge cycles.

Another objective of the present invention is to provide such a liquid transfer system which allows the maximum amount of liquids to be transferred per pumping cycle.

A still further objective of the present invention is to provide such a liquid transfer system which includes a diverter valve which requires minimal air pressure to switch between valve positions.

Another objective of the present invention is to provide such a liquid transfer system which provides a splash guard within the pump chamber to prevent corrosive, erosive or abrasive liquids from being splashed or drawn into the jet stream and contacting operational pump elements or being blown out the exhaust and into the surrounding environment.

These objectives and advantages are obtained by the magnetically controlled liquid transfer system of the present invention the general nature of which may be stated as including a liquid-receiving tank having an upper portion, a lower portion and a side wall which form a pump chamber; inlet and outlet passages communicating with the lower portion of the tank, and valve means associated with each of said passages for admitting and discharging a liquid into and out of the pump chamber; a venturi nozzle positioned in the upper portion of the tank and having first and second ends, said first end being adapted to communicate with a source of compressed air and the second end communicating with the pump chamber and with an exhaust passage; a diverter valve communicating with the exhaust passage which permits air flow out the exhaust passage when in an open position to create a vacuum condition within the pump chamber and for shutting off air flow through the exhaust passage to create a pressurized condition within the pump chamber when in a closed position; magnetic actuator means for controlling the position of the diverter valve; and float means within the pump chamber for controlling the magnetic actuator in relationship to the level of fluid within the pump chamber.

BRIEF DESCRIPTION OF THE DRAWINGS

A preferred embodiment of the invention illustrative of the best mode in which the applicant has contemplated applying the principles, is set forth in the following description and is shown in the drawings and is particularly and distinctly pointed out and set forth in the appended claims.

Similar numbers refer to similar parts throughout the drawings.

DESCRIPTION OF THE PREFERRED EMBODIMENT

Figure 1:
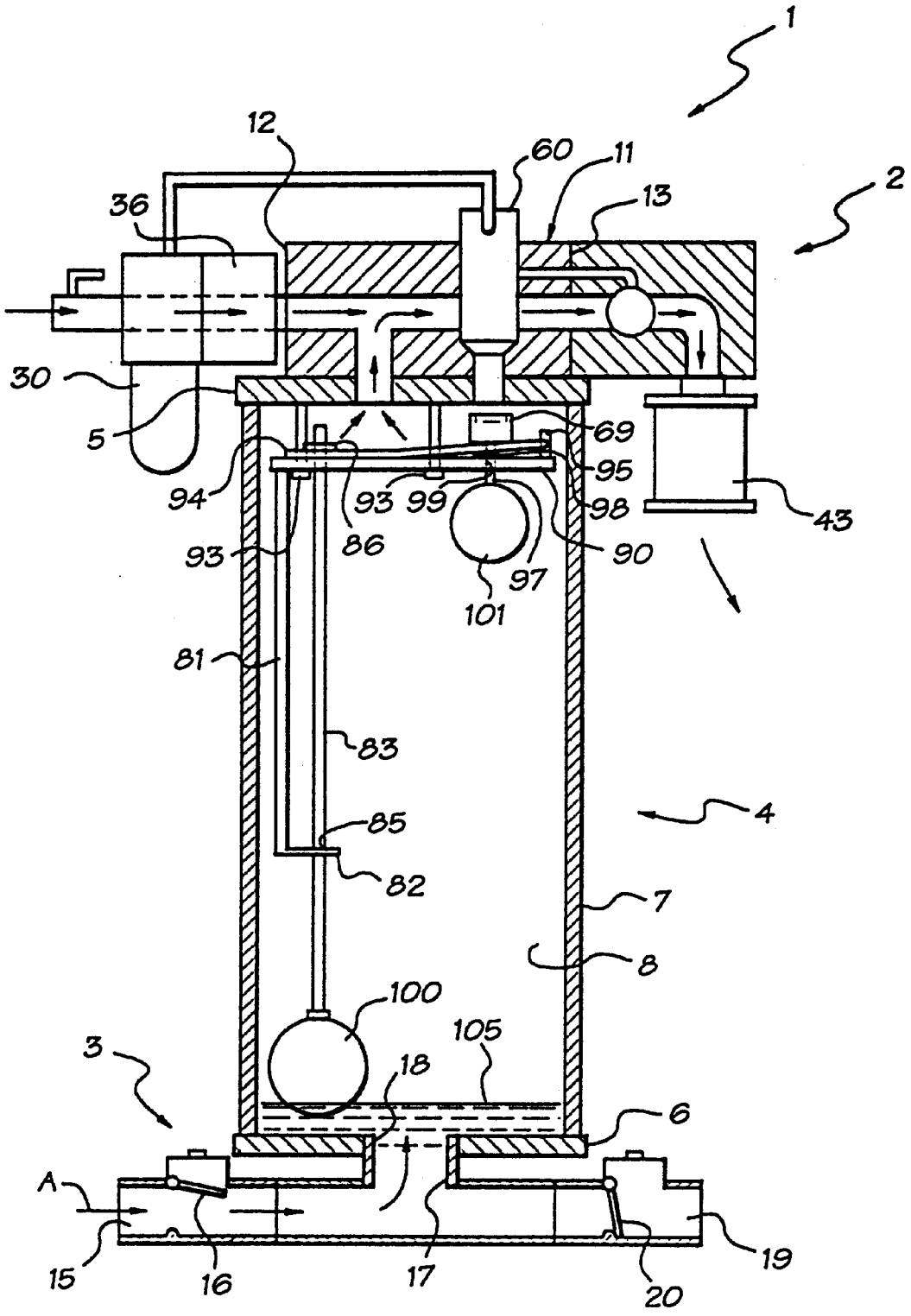
FIG. 1 is a diagrammatic sectioned view of the magnetically controlled liquid transfer system of the present invention during a suction cycle.

FIG. 1 shows the magnetically controlled liquid transfer system of the present invention during a suction cycle, which system is indicated generally as 1. System 1 includes an upper control portion indicated generally at 2, a lower fluid transfer portion indicated generally at 3 and a fluid-tight receiving tank indicated generally at 4. Receiving tank 4 includes a top closure plate 5, a bottom closure plate 6, and a cylindrical side wall 7 which form a pump chamber 8. A plurality of vertically extending rods 14 (FIG. 3) extend between top and bottom plates 5 and 6 and clamp them together against side wall 7 by use of nuts 9 and washers 10 to secure the top and bottom plates to side wall 7 to form tank 4.

Figure 2:
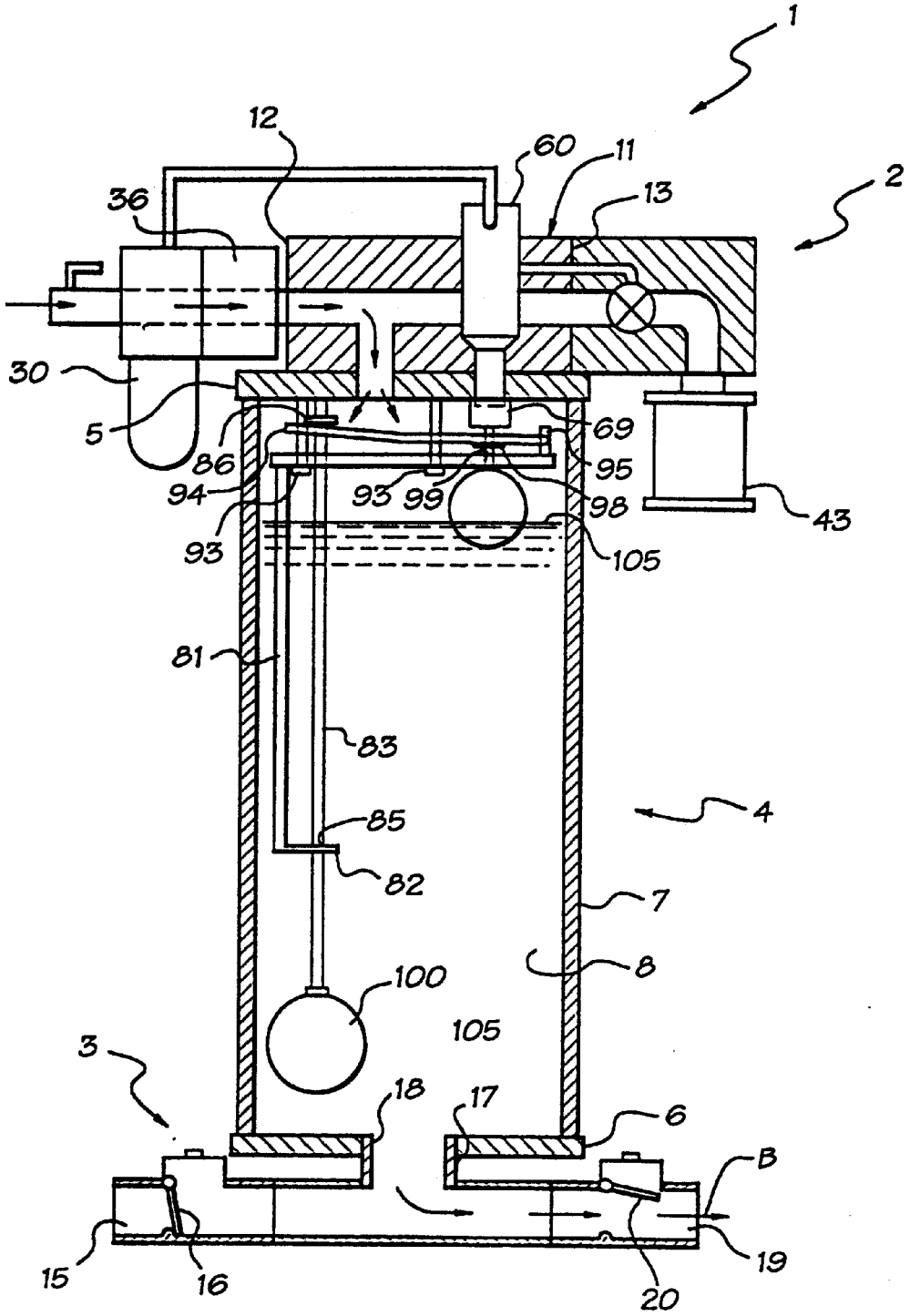
FIG. 2 is a sectioned view similar to FIG. 1 showing the system during a discharge cycle.

Lower portion 3 includes an inlet passage 15 which is adapted to be placed in communication with the liquid to be pumped to another location by system 1. The inlet passage is fitted with a one-way check valve 16 which permits liquid to flow only in the inlet direction indicated by arrows A, and through a T-fitting 17 into chamber 8. Fitting 17 communicates with an opening 18 formed in bottom plate 6 to allow the fluid to flow into pump chamber 8. Lower portion 3 further includes an outlet passage 19 which is fitted with a one-way check valve 20 to permit liquid to flow therethrough only in an outlet direction indicated by arrows B (FIG. 2). Outlet passage 19 communicates with T-fitting 17 whereby fluid flows out of chamber 8 through opening 18, through T-fitting 17 and out outlet passage 19 when in the discharge or pressure cycle.

Upper portion 2 is fastened to top plate 5 and includes a venturi manifold block 11 which houses the vacuum generating elements. Block 11 includes an inlet end 12 and an outlet end 13. A venturi nozzle 24 (FIG. 3) is removably inserted within a bore 25 formed in upper control portion 2. Venturi nozzle 24 has an axial bore 27 and first and second ends 26 and 28 respectively. Axial bore 27 is preferably formed in a converging/diverging shape to produce a supersonic jet stream of air which is discharged out of second end 28. Venturi nozzle 24 may be removed and replaced with nozzles with different bore sizes to alter the force of the jet stream, and thus alter the pump performance and rating.

Figure 4:
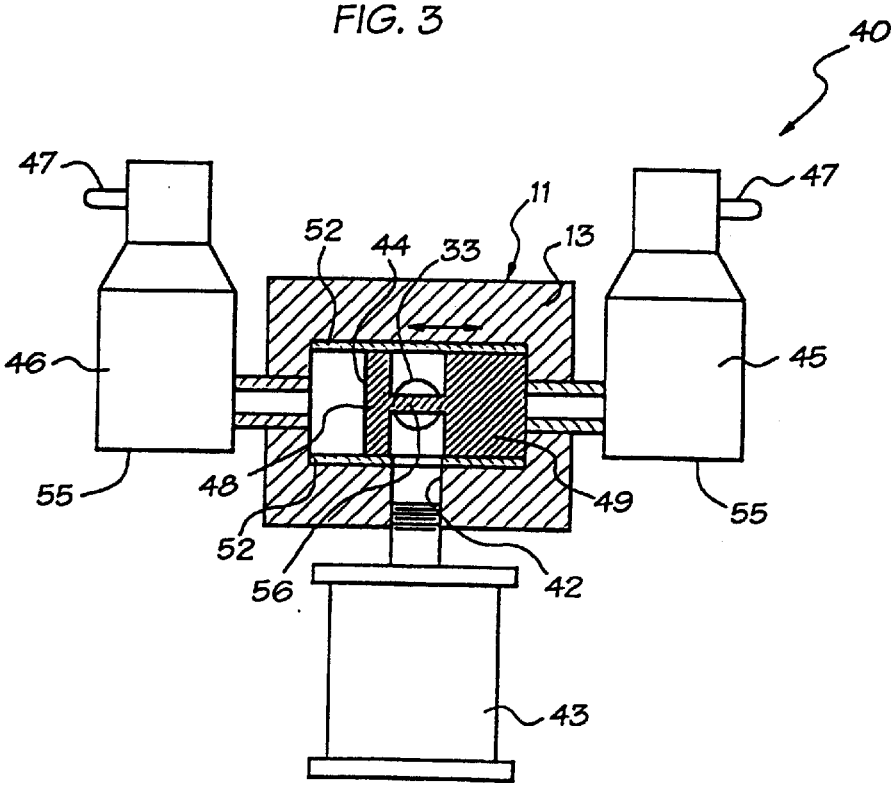
FIG. 4 is an enlarged sectional view of the diverter valve taken on line 4—4, FIG. 3.

A source for generating compressed air, such as an air compressor 22 (FIG. 7), communicates through a filter 30 and a regulator 36 with first end 26 of nozzle 24 by a hose 29 to supply compressed air to nozzle 24. After the jet stream of air passes out of second end 28 of nozzle 24 it travels through an inlet end 31 of bore 32 of a tube 34. Bore 32 is coaxially aligned with axial bore 27 and inlet end 31 is positioned in a spaced apart relationship relative to the second or discharge valve end 28 of nozzle 24. A vertically extending opening 35 is formed in upper portion 2 and in top plate 5 to permit communication between nozzle 24 and pump chamber 8. After passing through inlet 31, the jet stream of air passes through bore 32 of tube 34 before exiting outlet end 33 of tube 34 and into an air-actuated switch or diverter valve, indicated generally as 40 (FIG. 4).

Diverter valve 40 is fastened by usual attachments to outlet end 13 of venturi manifold block 11. Diverter valve 40 includes an exhaust port 42 (FIG. 4) and a muffler 43 connected thereto for deadening the sound produced by the pressurized air. A spool 44 is contained within diverter valve 40 and is formed of a low friction material such as TEFLON, and is generally H-shaped with a first spool end 48 and a larger second spool end 49, which are connected by a horizontal member 56. Spool 44 is contained in a stainless steel sleeve 52 which is mounted within valve 40.

A pair of usual quick exhaust valves 45 and 46 are connected to the sides of diverter valve 40 and communicate with the interior of sleeve 52. Both exhaust valves 45 and 46 have an attachment port 47 for connection to air hoses 53 and 54 respectively, for supplying pressurized air into sleeve 52. A quick exhaust opening 55 is formed in the bottom of each valve 45 and 46.

Air supply lines 53 and 54 are controlled by a usual three port magnetic air valve 60, such as manufactured by General Equipment and Manufacturing Co., Inc. of Louisville, Ky., and identified by its trademark 70 Series GO SWITCH. Magnetic air valve 60 has upper and lower portions. The upper portion includes an input port 61 which is connected to an input air hose 62, which is connected to the supply of compressed air, and two output ports 63 and 64 which are connected to air lines 53 and 54, respectively. The magnetic air valve 60 is screwed into a threaded hole formed in plate top 5 whereby the lower portion of magnetic air valve 60 communicates with the interior of chamber 8 where it is free to contact a ferrous actuator 69 as shown in FIG. 2.

Figure 5:
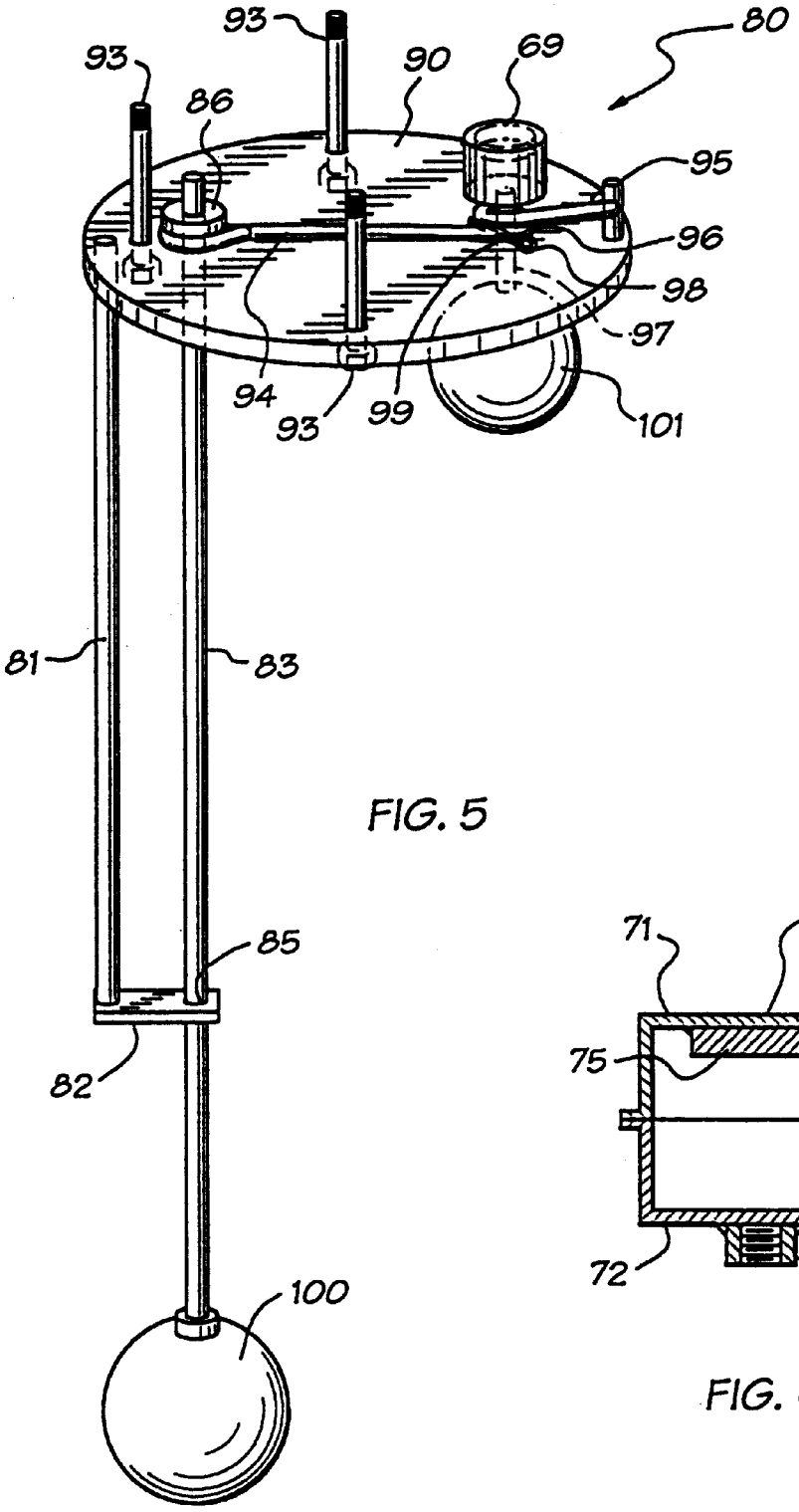
FIG. 5 is a perspective view of the float mechanism, the ferrous actuator and the splash guard plate of the magnetically controlled liquid transfer system of the present invention removed from within the tank chamber of FIGS. 1 and 2.
Figure 6:
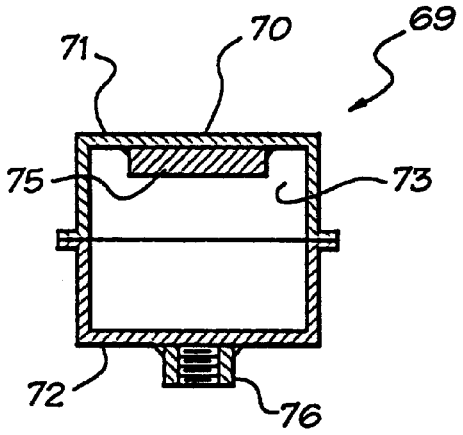
FIG. 6 is an enlarged sectional view of the ferrous actuator of FIG. 5.

Ferrous actuator 69 (FIGS. 5 and 6) includes a canister float 70 and a steel plug 75. Canister float 70 is generally cylindrical in shape and is constructed of a noncorrosive material such as stainless steel. Canister float 70 has a top wall 71 and a bottom wall 72 which form a hollow interior 73. Steel plug 75 is fastened to canister top wall 71 within interior 73 and an internally threaded hub 76 is mounted on bottom wall 72 for connection to a float mechanism, indicated generally at 80 (FIG. 5).

Float mechanism 80 includes a disk-shaped splash guard plate 90 which is mounted within pump chamber 8. Plate 90 is spatially attached to plate top 5 of tank 4 by a plurality of bolts 93 which extend through a plurality of holes formed in plate 90 and are received in internally threaded holes formed in the bottom of top plate 5 (FIG. 1). A vertical support rod 81 is attached to plate 90 and extends in a vertically downward direction. A horizontally extending bar 82 is attached to the bottom of rod 81 and is formed with a guide hole 85 which allows for the free passage and movement of float rod 83 therethrough. Rod 83 extends vertically and parallel to support rod 81 and extends through a hole 92 formed in plate 90. A retainer ring 86 is attached to the upper end of float rod 83. A bottom float 100 is attached to the lower end of float rod 83 and is located adjacent the bottom of pump chamber 8 (FIG. 1).

A switch arm 94 is mounted on plate 90 and includes first and second ends and a serpentine curve 96 located between the ends. The first end of arm 94 is loosely connected around float rod 83 between retainer 86 and plate 90. The second end is pivotally attached to a post 95 which extends vertically upwardly from plate 90. Serpentine curve 96 encircles an actuating rod 97 (FIG. 5). Actuating rod 97 extends vertically through a hole formed in plate 90 and one end is threaded and is connected to internally threaded hub 76 of ferrous actuator 69 above plate 90. A top float 101 is attached to the other end of actuating rod 97 below and adjacent to plate 90. A cotter pin 98 is inserted through a hole in actuating rod 97 and is located above plate 90 and below serpentine curve 96 of arm 94.

Figure 3:
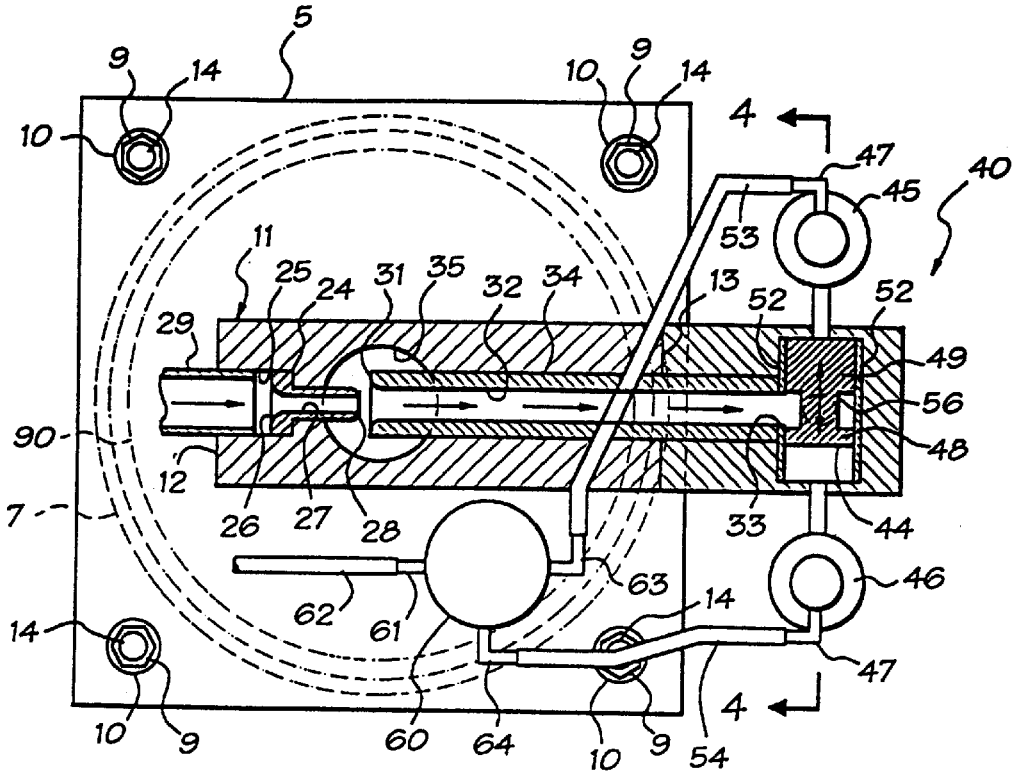
FIG. 3 is a top plan view with portions in section, of the magnetically controlled liquid transfer system as shown in FIG. 1.

In operation the pressurized air passes through venturi nozzle 24, through tube 34 and enters diverter valve 40. When diverter valve 40 is in an open position (FIGS. 1, 3, and 4) pressurized air flows through diverter valve 40, exhaust port 42 and muffler 43. Diverter valve 40 is toggled between closed and open positions by supplying air to quick exhaust valves 45 and 46, controlled by magnetic air valve 60. When pressurized air is supplied to valve 46 through air valve 60, it pushes spool end 48 away from valve 46, opening diverter valve 40 as shown in FIGS. 1, 3, and 4. When diverter valve 40 is in this open position the jet stream of air passes through tube 34 and out exhaust port 42 and muffler 43 creating a suction condition within pump chamber 8 (FIG. 1), through opening 35. To close diverter valve 40 and change the system from the suction mode to the pressure mode, where spool end 49 blocks the flow of air between tube 34 and exhaust port 42, the air pressure is supplied through air hose 53 and into valve 45 which moves spool end 49 away from valve 45 and adjacent tube 33 to force the pressurized air through port 42 and into chamber 8. When this condition exists, a downward pressure is applied to the liquid indicated at 105 (FIG. 2) in pump chamber 8, forcing the liquid out through check valve 20 and outlet passage 19 (FIG. 2). The openings in quick exhausts 55 provide a vent for any standing air which may be trapped adjacent to the spool to be discharged to the atmosphere without applying any back pressure against the moving spool.

Ferrous actuator 69 toggles the position of magnetic air valve 60 from a normally close position (FIG. 2), in which air is supplied through air line 53 closing diverter valve 40, to an open position in which air is supplied through air line 54 opening diverter valve 40.

When in the suction mode of FIG. 1, liquid is drawn into chamber 8 through check valve 16 and raises float rod 83 upwardly until it abuts top plate 5. When the level of fluid 105 reaches top float 101 (FIG. 2) bottom float 100 has been raised and float rod has contacted plate top 5 of receiving tank 4 lifting retainer 86 off of switch arm 94, freeing the switch arm and allowing it to move vertically upwardly. The fluid level raises top float 101 until ferrous actuator 69 contacts magnetic air valve 60. When top float 101 is raised, cotter pin 98 also raises and pivots switch arm 94 on post 95 and holds switch arm 94 in an up position.

When ferrous actuator 69 contacts magnetic air valve 60 the valve is toggled changing the direction of the air flow from air line 54 into line 53 moving spool 44 to divert the air flow into chamber 8 forcing the fluid out of the chamber through valve 20. As the fluid is discharged from the tank the ferrous actuator remains in contact with the magnetic air valve and the switch arm is held in the up position (FIG. 2) by float 100. The fluid level eventually drops below bottom float 100 which then lowers, forcing switch arm 94 downward against cotter pin 98 through retainer 86. Cotter pin 98 forces actuating rod 97 downwardly and thus the ferrous actuator downwardly, breaking contact between the ferrous actuator and the magnetic air valve. The magnetic air valve is then actuated and returns to its normally closed position wherein air is supplied through air line 54 to move spool 44 to the suction mode of operation as shown in FIGS. 1, 3, and 4.

Figure 7:
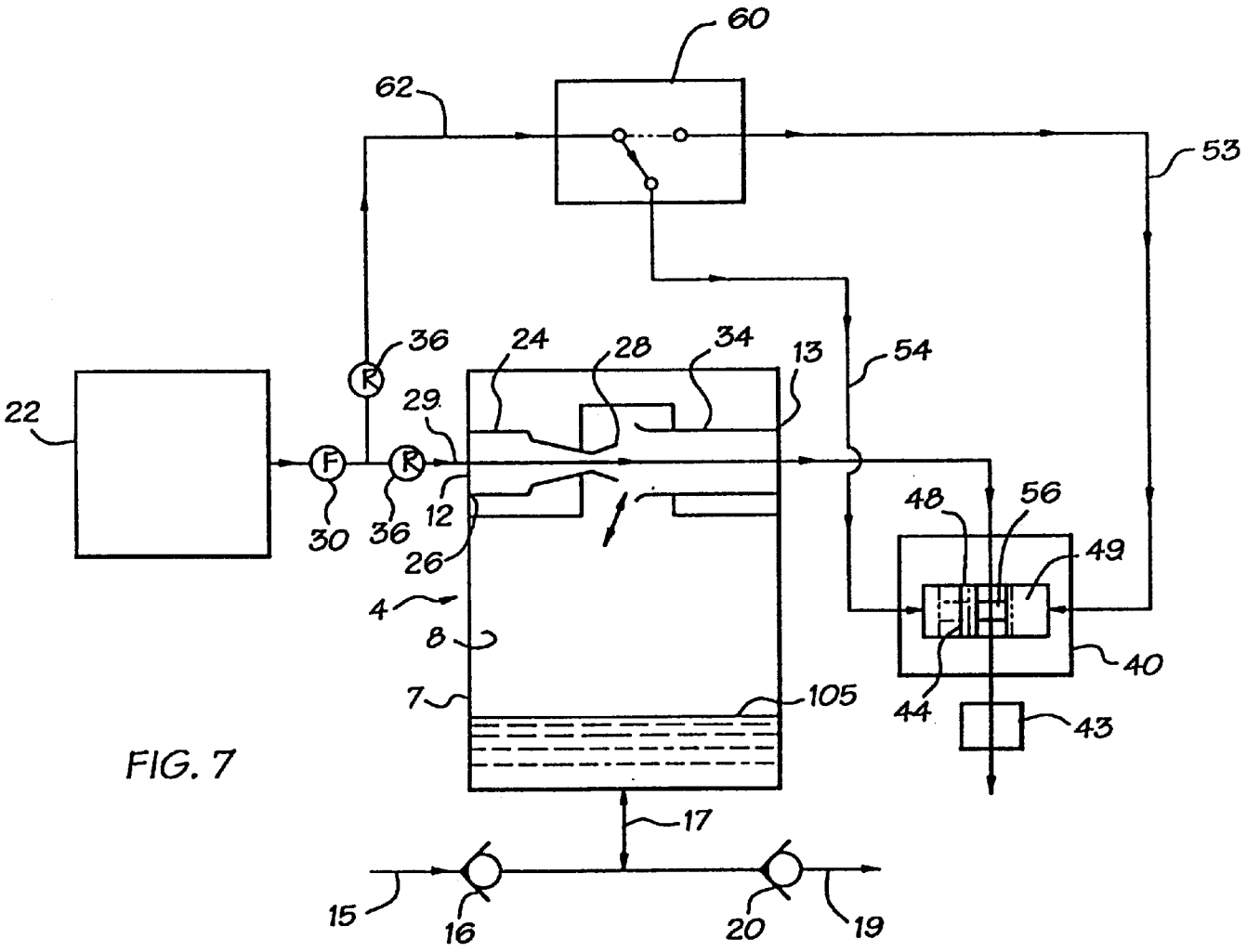
FIG. 7 is a schematic diagram of the magnetically controlled liquid transfer system of the present invention.

The above-described fluid and air flow is shown diagrammatically in FIG. 7 to facilitate the understanding and method of operation of the improved system of the present invention.

It is understood that the double-acting diverter valve 40 can be replaced with a valve having only a single air line connected thereto to move the spool to the closed position with an internal spring biasing the spool to a normally open position or vice versa without affecting the concept of the invention.

Figure 8:
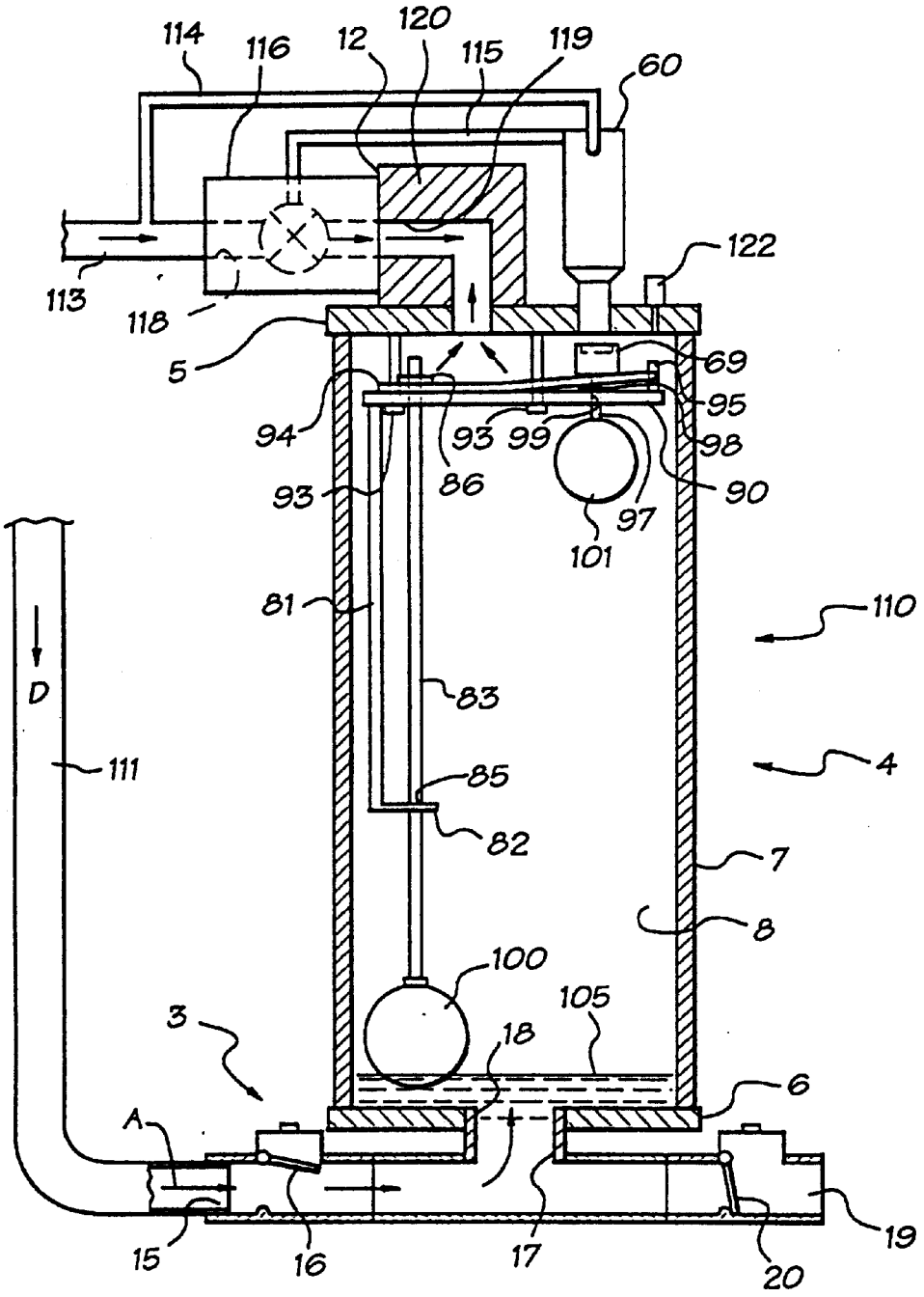
FIG. 8 is a diagrammatic sectional view similar to FIGS. 1 and 2 showing a modified embodiment of the liquid transfer system of the present invention when used in a condensation-type of system.

A modified liquid transfer system of the present invention is indicated generally at 110 and is shown in FIG. 8. System 110 is similar in most respects to system 1 described above and, thus, the same numerals will be used for similar parts throughout. In system 110, inlet passage 15 is connected to an incoming fluid line 111 which is connected to a source of liquid which flows into line 111 in the direction of arrow D under the influence of gravity, such as from a liquid source higher than the upper portion of tank 4. This liquid then flows into pump chamber 8 through check valve 16 until the floats are actuated, as described above.

In system 110, a main compressed air line 113 communicates with the source of pressurized air, such as air compressor 22, with a first branch line 114 extending from line 113 to magnetic air valve 60. A second branch line 115 extends from air valve 60 to a usual air-actuated ON/OFF switch 116, which is formed with an internal air passage 118 which provides fluid communication between incoming air line 113 and an air passage 119 formed in an upper housing 120 which is mounted on top closure plate 5. Passage 119 communicates through the top plate opening to pump chamber 8, as shown in FIG. 8. Switch 116 operates in a somewhat similar manner as does diverter valve 40, described above.

In operation, the incoming fluid will enter pump chamber 8 through line 111 under the influence of gravity, which will raise the fluid level from its-lower level, as shown in FIG. 8, to an upper level, as shown in FIG. 2. A usual air release valve 122 preferably is mounted on plate 5 to permit air trapped within chamber 8 above the fluid level to be discharged therethrough to permit the fluid level 105 to raise within chamber 8. Air-actuated switch 116 preferably is a normally closed switch which will then block the passage of pressurized air therethrough until the liquid level reaches the position of FIG. 2. Upon the liquid reaching the upper position of FIG. 2, ferrous actuator 69 will actuate magnetic air valve 60 which is normally closed, which will then permit the flow of pressurized air from line 113 to flow through branch line 114 and through branch line 115 to actuate switch 116. When switch 116 is in the open position, the pressurized air will then flow through line 113 and opening 119 and into the upper portion of chamber 8 to force the liquid out through passage 19. The floats will then control air valve 60 in the manner described above with respect to system 1, whereupon the liquid dropping to its lower level will then cause air valve 60 to be actuated, blocking the flow of air through line 115, permitting switch 116 to return to its normally closed position, blocking the further flow of pressurized air into pump chamber 8 and starting another pumping cycle, permitting the liquid to flow through pipe 111 into chamber 8 over a predetermined time period.

System 111 uses a condensation-type of pump-operating principle but has the new and improved magnetic control feature incorporated therein.

Accordingly, the magnetically controlled liquid transfer system of the present invention enables a more accurately controlled filling and discharge of the storage tank without any of the liquid accidentally contacting various operational portions of the pump or being discharged into the surrounding atmosphere, and avoids repeated adjustments of the discharge and fill timing periods regardless of the viscosities of the particular liquid being conveyed, and which achieves the desired objectives in a relatively simple, inexpensive, yet highly efficient and low-maintenance manner.

Accordingly, the liquid transfer system is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

I claim:

1. A pumping device for pumping liquids including:

a liquid-receiving tank having an upper portion, a lower portion and a side wall which form a pump chamber;

inlet and outlet passages communicating with the lower portion of the tank, and valve means associated with each of said passages for admitting and discharging a liquid into and out of the pump chamber;

a venturi nozzle positioned in the upper portion of the tank and having first and second ends, said first end being adapted to communicate with a source of compressed air and the second end communicating with the pump chamber and with an exhaust passage;

a diverter valve communicating with the exhaust passage which permits air flow out the exhaust passage when in an open position to create a vacuum condition within the pump chamber and for shutting off air flow through the exhaust passage to create a pressurized condition within the pump chamber when in a closed position;

magnetic actuator means for controlling the position of the diverter valve; and float means within the pump chamber for controlling the magnetic actuator means in relationship to the level of fluid within the pump chamber.

2. The pumping device defined in claim 1 in which the second end of the venturi nozzle communicates with the pump chamber through an air opening formed in the upper portion of the tank; and in which said second end is in a spaced relationship to a first end of an axially aligned opening of the exhaust passage.

3. The pumping device defined in claim 1 in which the float means includes a top float and a bottom float.

4. The pumping device defined in claim 1 in which the magnetic actuator means includes a magnetic switch and an air valve.

5. The pumping device defined in claim 4 in which the air valve communicates with the supply of compressed air for controlling the diverter valve to selectively create the vacuum condition and the pressure condition within the pump chamber.

6. The pumping device defined in claim 5 in which the diverter valve includes at least one air inlet port and a slide spool for opening and closing the exhaust passage.

7. The pumping device defined in claim 6 in which the supply of compressed air is selectively connected to the air inlet port of the diverter valve through the air valve for moving the spool to permit opening and closing of the exhaust passage.

8. The pumping device defined in claim 7 in which a quick exhaust valve communicates with the compressed air inlet port of the diverter valve.

9. The pumping device defined in claim 3 in which the float means further includes a plate mounted in the upper portion of the tank, a switch arm movably mounted on the plate, and a ferrous actuator movable by the switch arm for operating the magnetic actuator means.

10. The pumping device defined in claim 9 in which the top float controls the movement of the ferrous actuator upon the liquid reaching an upper level in the pump chamber.

11. The pumping device defined in claim 9 in which the bottom float includes a rod which operatively engages the switch arm, enabling said switch arm to move the ferrous actuator out of engagement with the magnetic actuator means upon the liquid reaching a lower level to actuate the diverter valve to move to the open position and stop the pressurized condition within the pump chamber.

12. The pumping device defined in claim 11 in which a support rod is attached to the plate and extends toward the lower portion of the tank and has a guide arm formed with a hole for slidably receiving the rod of the bottom float therein.

13. The pumping device defined in claim 9 in which the plate is formed with a pair of holes; and in which each of the floats includes a rod which extends through a selective one of said plate holes.

14. The pumping device defined in claim 2 in which the plate is spatially attached to the upper portion of the receiving tank and extends over the air opening formed in the upper portion of the tank, whereby the plate prevents liquids from entering said opening.

15. A pumping device for pumping liquids including:

a liquid-receiving tank having an upper portion, a lower portion and a wall which form a pump chamber;

inlet and outlet passages communicating with the tank, and valve means associated with each of said passages for permitting the passage of a liquid into and out of the pump chamber;

air inlet means formed in the upper portion of the tank adapted to communicate with a source of pressurized air for directing the pressurized air into the pump chamber to discharge the liquid from the chamber and out through the outlet passage;

air-actuated switch means adapted to communicate with the source of pressurized air for regulating the flow of pressurized air through the air inlet means and into the pump chamber;

magnetic actuator means for controlling the position of the air-actuated switch means; and float means within the pump chamber for controlling the magnetic actuator means in relationship to the level of fluid within the pump chamber.

16. The pumping device defined in claim 15 in which the air inlet means includes a main incoming air line adapted to communicate with the source of pressurized air, a first branch line connecting the main air line to the magnetic actuator means and a second branch line operatively connecting the magnetic actuator means to the air-actuated switch means.

17. The pumping device defined in claim 15 in which the float means includes a top float which actuates the magnetic actuator means to allow the flow of pressurized air into the pump chamber upon the liquid reaching a predetermined upper level in the pump chamber, and a bottom float which maintains the magnetic actuator means actuated until the liquid reaches a predetermined lower level in the pump chamber.

18. The pumping device defined in claim 15 in which the air inlet means includes a venturi nozzle and an exhaust passage communicating with said nozzle for creating a vacuum condition within the pump chamber when the air-actuated switch means is in a first position permitting the flow of pressurized air through said nozzle; and in which said venturi nozzle creates a pressurized condition within the pump chamber when said switch means is in a second position blocking flow of the pressurized air through the exhaust passage.

19. The pumping device defined in claim 15 in which the air-actuated switch means is an ON/OFF switch which opens and closes an air passage in said switch.

20. The pumping device defined in claim 15 including relief valve means communicating with the pump chamber for discharging air trapped within the pump chamber when fluid is being admitted into said chamber.

* * * * *